US010953265B2

(12) United States Patent
Aasa et al.

(10) Patent No.: US 10,953,265 B2
(45) Date of Patent: Mar. 23, 2021

(54) CONNECTOR FOR WEIGHT LIFTING APPARATUS

(71) Applicants: Jesper Aasa, Umeå (SE); Björn Aasa, Umeå (SE)

(72) Inventors: Jesper Aasa, Umeå (SE); Björn Aasa, Umeå (SE)

( * ) Notice: Subject to any disclaimer, the term of this patent is extended or adjusted under 35 U.S.C. 154(b) by 0 days.

(21) Appl. No.: 15/995,381

(22) Filed: Jun. 1, 2018

(65) Prior Publication Data

US 2018/0272176 A1 Sep. 27, 2018

Related U.S. Application Data

(63) Continuation of application No. PCT/SE2016/051225, filed on Dec. 6, 2016.

(30) Foreign Application Priority Data

Dec. 7, 2015 (SE) ..... 1551603-2

(51) Int. Cl.
*A63B 21/078* (2006.01)
*A63B 21/062* (2006.01)

(52) U.S. Cl.
CPC ..... *A63B 21/0783* (2015.10); *A63B 21/062* (2013.01); *A63B 21/0626* (2015.10);
(Continued)

(58) Field of Classification Search
CPC ..... A63B 21/0615; A63B 21/0616; A63B 21/0617; A63B 21/062; A63B 21/0622; A63B 21/0624; A63B 21/0626; A63B 21/0628; A63B 21/063; A63B 21/0632; A63B 21/078; A63B 21/0783; A63B 21/08; A63B 21/15; A63B 21/159; A63B 21/16; A63B 21/22; A63B 21/4027; A63B 21/4033; A63B 21/4035; A63B 21/4041; A63B 21/4043; A63B 21/4045;
(Continued)

(56) References Cited

U.S. PATENT DOCUMENTS 5,123,885 A * 6/1992 Shields ..... A63B 21/0728 482/106
5,460,588 A * 10/1995 Tate ..... A63B 21/078 482/104

(Continued)

*Primary Examiner* — Gary D Urbiel Goldner
(74) *Attorney, Agent, or Firm* — Gabriela B. Tomescu, Esq.; Bergenstråhle & Partners AB

(57) ABSTRACT

A connector for a weightlifting apparatus, the weightlifting apparatus having a sliding rail, and slots or lateral protrusions, the connector comprising a main body slidably attached to the sliding rail, a support arm having a support surface and extending outwardly from the main body, a rotational latching device having first and second opposing ends, the first opposing end for engaging the slots or lateral protrusions, and the second opposing end comprising a recess for receiving a barbell in a form-fit connection to achieve a rotationally rigid coupling such that rotation of the barbell is transferred to the rotational latching device, and a barbell lock to releasably lock the barbell in the recess. The support surface supports the barbell during free weight exercise when the barbell is not locked in the barbell lock, and when the first opposing end is engaged with the slots or lateral protrusions.

6 Claims, 6 Drawing Sheets

(52) U.S. Cl.
CPC ..... *A63B 21/0628* (2015.10); *A63B 21/078* (2013.01); *A63B 2244/09* (2013.01)

(58) Field of Classification Search
CPC ..... A63B 21/4047; A63B 21/4049; A63B 71/0054; A63B 2071/0063; A63B 2071/0072; A63B 2071/0081; A63B 2071/009; A63B 2208/0223; A63B 2225/09; A63B 2225/093; A63B 2244/09
See application file for complete search history.

(56) References Cited

U.S. PATENT DOCUMENTS 5,651,758 A * 7/1997 Cervantes ..... A63B 21/078 482/108
5,727,764 A * 3/1998 Angeles ..... A47B 57/482 248/219.4
6,685,601 B1 * 2/2004 Knapp ..... A63B 21/078 482/104
6,905,446 B2 * 6/2005 Greenland ..... A63B 21/06 482/100
7,094,185 B2 * 8/2006 Greenland ..... A63B 21/06 482/100
7,488,277 B1 * 2/2009 Knapp ..... A63B 21/078 482/104
7,549,950 B1 * 6/2009 Lundquist ..... A63B 21/078 482/101
8,337,370 B2 * 12/2012 Rogers ..... A63B 71/0036 482/104
9,381,393 B1 * 7/2016 Gonzalez ..... A63B 21/078
9,492,701 B1 * 11/2016 Bognatz ..... A63B 21/072
9,597,539 B2 * 3/2017 Grider ..... A63B 17/04
2006/0035765 A1 * 2/2006 Smith ..... A63B 21/078 482/94
2009/0143203 A1 * 6/2009 Knapp ..... A63B 23/0355 482/104
2013/0184128 A1 * 7/2013 Towley ..... A63B 21/156 482/102
2014/0200117 A1 * 7/2014 Grider ..... A63B 17/04 482/104
2015/0191918 A1 * 7/2015 Atkinson ..... E04F 15/107 428/205
2015/0290488 A1 * 10/2015 Hopperstad ..... A63B 23/0405 482/38
2018/0056108 A1 * 3/2018 Kelly ..... F16M 13/022

* cited by examiner

CONNECTOR FOR WEIGHT LIFTING APPARATUS

This application is the continuation of International Application No. PCT/SE2016/051225, filed 6 Dec. 2016, which claims the benefit of Swedish Patent Application No. SE-1551603-2, filed 7 Dec. 2015, the entire contents of which are hereby incorporated by reference.

TECHNICAL FIELD

The present invention relates generally to exercise equipment especially used in weight training and more specifically to a connector for a weight lifting apparatus and a weight lifting apparatus comprising such a connector.

BACKGROUND ART

Exercise trends in weight training constantly change with time. Presently, weight training for both regular exercisers and elite athletes in all sports is dominated by training with free weights. For example, weight lifting using an Olympic size barbell is one of the fundamental features of training at gyms around the world today. Free weight lifting activates a plurality of muscle groups in that the user must stabilise the weights and keep his or her balance. As such, training with free weights also places great demands on the exerciser.

As an alternative, the Smith machine was developed in the 1950s. The Smith machine consists of a barbell that is fixed within steel rails, allowing only vertical or near-vertical movement. Behind each vertical post (runner) is a series of slots on which the barbell can be hooked. This means that unlike an ordinary barbell, the Smith machine need not be re-racked after a set of repetitions: it can be secured at any point. This supposedly makes it safer for those who lift without a spotter, as one only needs to twist the wrist in order to lock the barbell in place in the event that the weight becomes too great. On the other hand, the Smith machine requires less stabilisation and balance by the lifter since it is restrained to move only in one plane, which means that only selected muscle groups are activated during lifting.

By alternately combining both free weight training and weight lifting with a fixed path movement such as in a Smith machine, an optimal exercise regime may be achieved focusing on the advantages of both types.

There exist a number of solutions to combine Smith machine functionality with the possibility of free weight lifting. U.S. Pat. No. 7,488,277 discloses a compact weight-lifting frame system including barbell holders which releasably hold the barbell such that the barbell can be removed and used freely. However, the barbell holder can only hold the barbell in a locked configuration, i.e. the exerciser wishing to rest between repetitions of free weight lifting must place the barbell in a separate rack.

As such there is currently lacking a weight training equipment that fully combines training in machine-controlled movement path with the exercise of free weights. Such tools can optimise both the rehab training, daily exercise and elite training. Thus, there is a need for a tool which conveniently and fully combines the advantages of a fixed and controlled movement path and the benefits of exercise with a free weight.

SUMMARY OF THE INVENTION

An object of the present invention is to provide an improved weight lifting apparatus adapted to combine fixed and controlled movement with free weight exercise in one compact piece of equipment. Accordingly, in a first aspect there is provided a connector for a weight lifting apparatus, adapted to be slidably attached to a sliding rail of the weight lifting apparatus and comprising means for releasably securing a barbell, wherein the connector further comprises a support arm for supporting the barbell when the barbell is not secured in the securing means. The connector further comprises a rotational latching device adapted to engage lateral protrusions of the weight lifting apparatus.

By providing a connector adapted to releasably secure the barbell and also support the barbell in a free, unlocked configuration, a compact weightlifting apparatus which combines both movement in a fixed and controlled path as well as free weight exercise in one single piece of equipment is achieved. Another advantage with the connector is that it may be retrofitted to existing weight lifting apparatus to convert it to provide the dual function of fixed path movement and free weight exercise. This saves the cost of replacing the whole weight lifting apparatus. Additionally, it enables attachment of any suitable barbell to the weight lifting apparatus adapted to individual users or specific types of exercise.

In preferred embodiment, the support arm acts as securing means and may be brought between a first position wherein the barbell is supported by the support arm, and a second position wherein the support arm locks the barbell. Thereby a simple and safe solution for locking and unlocking the barbell is achieved which is easy to use.

In a further preferred embodiment, the support arm is pivotally attached to the connector about an axis substantially perpendicular to the longitudinal extension of the connector. The pivotal connection is a robust construction advantageous for bringing the support arm between the first and second positions with minimum effort.

In an advantageous embodiment, the connector further comprises fastening means to releasably lock the support arm in the second position. The fastening means prevents inadvertent release of the barbell from the locking position.

In a preferred embodiment, the support arm comprises an abutment member adapted to abut against the connector in the first position. The abutment member acts to limit the pivoting motion of the support arm and thereby also provides additional strength to support the barbell when used as a rack during free weight exercise.

In an alternative embodiment, the securing means are configured to receive the barbell in a rotationally rigid coupling such that rotation of the barbell is transferred to the securing means. By providing a rotationally rigid coupling between the barbell and the securing means, easy transfer of torque between the barbell and the securing means is achieved.

In an advantageous embodiment, the rotational latching device comprises a hook rotationally attached to the connector and adapted to engage slots or protruding parts on a frame of the weight lifting apparatus, and wherein the hook comprises a recess adapted to receive the barbell in a form-fit connection. The form-fit connection facilitates manufacturing and enables easy transfer of torque between the barbell and the hook. Thereby a simple and compact solution for hooking and unhooking the barbell is achieved.

In a preferred embodiment, the connector further comprises a sleeve adapted to be fastened on the barbell and having a shape corresponding to the shape of the recess. The corresponding, mating shapes of the recess and sleeve ensures easy transfer of torque between the barbell and the hook. Preferably In a preferred embodiment, the recess and the sleeve both have corresponding regular polygon shapes, preferably a quadratic shape, a pentagonal shape or a hexagonal shape. Alternatively, at least part of the recess has the shape of an internal gear and the sleeve has the shape of an external gear adapted to mesh with each other. The corresponding mating or meshing shapes of the recess and sleeve, respectively, ensure a tight and responsive rotational coupling.

In an alternative embodiment, the hook constitutes the securing means. By utilising the hook itself as securing means, a more compact solution for the connector is achieved where both the securing and engaging/disengaging function is performed by the same component.

In an advantageous embodiment, the recess comprises a retaining shoulder formed in an upper part of the recess and adapted to retain the barbell in the recess. The retaining shoulder further improves the securing function to ensure that the barbell remains in place in the recess during lifting and engaging/disengaging the hook.

In an alternative embodiment, the hook and the barbell comprise a magnetic or ferromagnetic material. The magnetic force between the hook and the barbell provides a substantially rigid rotational coupling.

In a preferred embodiment, the recess and/or the barbell is covered with a high friction material. Applying a material such as e.g. rubber to the surface of the recess and/or the barbell increases the friction and thereby achieves a substantially rigid rotational coupling.

In an advantageous embodiment, an internal bore of the connector in which the rail of the weight lifting apparatus is received, comprises a longitudinal boss or groove adapted to engage with a corresponding groove or boss arranged on the rail. The engagement between the boss and the groove prevents rotation of the connector about the rail of the Smith machine.

In a second aspect, there is provided a weight lifting apparatus comprising at least one connector according to the first aspect.

BRIEF DESCRIPTION OF DRAWINGS

The invention is now described, by way of example, with reference to the accompanying drawings, in which.

DETAILED DESCRIPTION OF EMBODIMENTS

Figure 1:
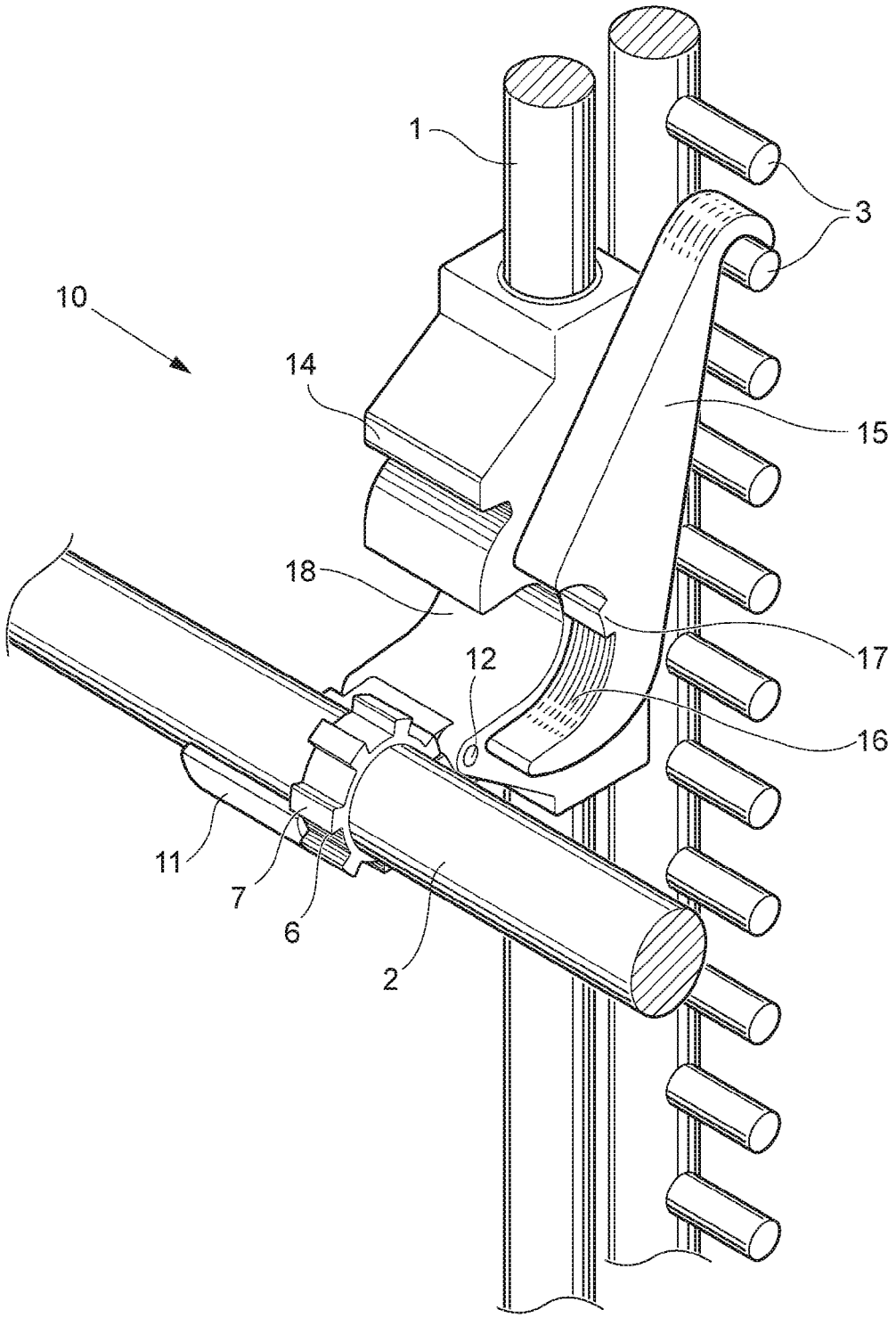
FIG. 1 shows a perspective view of a connector according to a first embodiment.

In the following, a detailed description of connector for a weight lifting apparatus according to the invention is presented. In the drawing figures, like reference numerals designate identical or corresponding elements throughout the several figures. It will be appreciated that these figures are for illustration only and are not in any way restricting the scope of the invention.

A weight lifting apparatus known in the art, such as a Smith machine, will now be discussed. Hence forth, the term Smith machine will be used to describe a weight lifting apparatus with a fixed and controlled movement path. It should however be clear that the connector of the present invention is not limited to use with Smith machines only, but may be used with any weight lifting apparatus with a fixed and controlled movement path. A conventional Smith machine comprises a pair of parallel upright steel pipes arranged a distance apart. On each steel pipe, a bearing is arranged to slide up and down along the pipe. A barbell is fixed to or integrally formed with each bearing such that movement of the barbell is restricted to the plane defined by the two steel pipes. Arranged immediately behind and parallel to each pipe is a weight lifting rack having uprights including a plurality of lateral, spaced apart protrusions. This rack provides a stable frame for the Smith machine. The purpose of the protrusions on the rack is to provide locking positions at different heights for the barbell when the user finishes his set of repetitions.

In FIG. 1, a perspective view of a connector 10 according to a first embodiment is shown. The connector 10 is intended to replace the conventional bearing of the Smith machine and thereby enable the combination of free weight exercise with fixed movement training. The connector 10 comprises a main body 14 in the shape of a sleeve with an internal bore and is adapted to surround and slide along the steel pipe or rail 1 of the Smith machine. The sleeve may have a substantially cylindrical shape, or any other suitable shape. Extending outwardly from the connector 10 in a direction substantially perpendicular to the rail 1 is a support arm 11 which may be integrally formed with or attached to the connector 10. The support arm 11 provides a support or rack for a barbell 2 when used in free weight exercise. In use, a connector 10 is mounted on respective rails 1 of the Smith machine to provide two points of attachment for the barbell 2.

To this end, the connector 10 comprises means for releasably securing the barbell 2 such that the barbell 2 may only be moved in a fixed, controlled direction defined by the rails 1 of the Smith machine. The securing means may be realised in different ways, as will be described below.

Figure 2A:
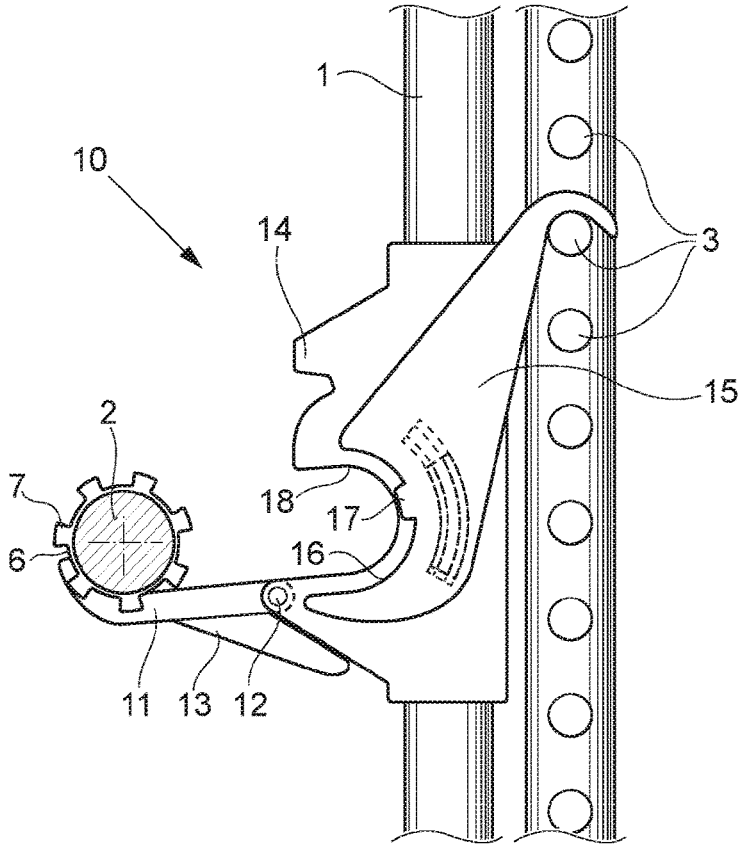
FIGS. 2*a* and 2*b* show side and frontal views of the connector in FIG. 1 in a first position.
Figure 2B:
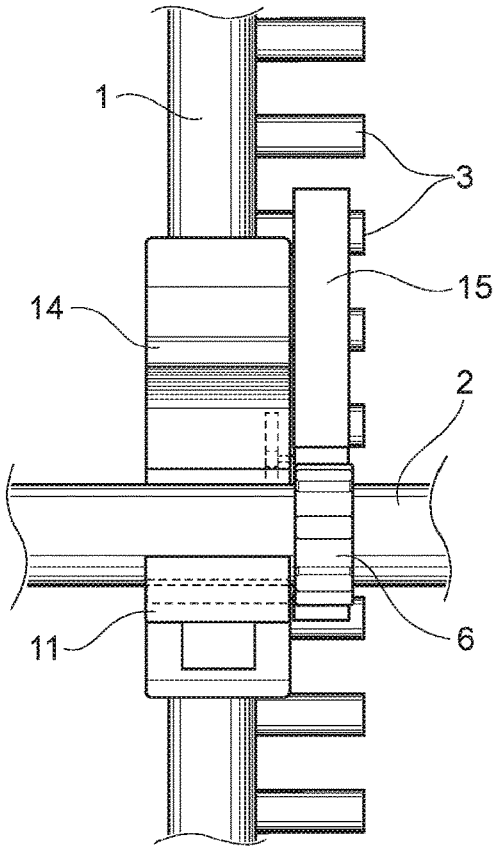

In a first embodiment, the support arm 11 acts as securing means. As shown in FIGS. 2*a* and 2*b*, the support arm 11 is pivotally attached to the connector 10 about an axis 12 substantially perpendicular to the longitudinal extension of the connector 10 and the rail 1, and substantially parallel to the barbell 2. The pivotal connection enables the support arm 11 to be pivoted from a first position shown in FIGS. 2*a* and 2*b*, wherein the support arm 11 extends outwardly from the connector 10 to provide a support surface for the barbell 2, to a second position shown in FIGS. 3*a* and 3*b*, wherein the support arm 11 has been pivoted upwardly by about 90° to lock the barbell 2 in a secure manner. In the second position, the barbell 2 is received in a recess 18 provided in the main body 14 of the connector 10. The outer end portion of the support arm 11 may be slightly upwardly bent to prevent the barbell 2 from rolling off and also provide a means for securely fastening the support arm 11 to the connector 10 in the second position.

The inner end portion of the support arm 11, closest to the connector 10, may comprise an abutment member 13 adapted to abut against the connector 10 in the first, horizontal position in order to limit the pivoting motion of the support arm 11 and thereby provide additional strength to support the barbell 2.

The connector 10 comprises a horizontal groove in an upper portion of the main body 14 which is adapted to receive the outer end portion of the support arm 11. Furthermore, the connector 10 comprises fastening means (not shown) for releasably locking the support arm 11 in the upright position to ensure that the barbell 2 remains securely locked. The fastening means comprises e.g. a pin biased toward a locking position by means of a spring, which enables quick release by simply pressing or pushing the pin. Other means of locking the support arm 11 comprises e.g. a clamp, clasp, ring or buckle arranged to slide or be folded over the outer end portion of the support arm 11 to hold it in place. Another solution involves providing the pivotal connection with a locking function in the upright position, e.g. by providing a slot on the support arm 11 such that the support arm 11 may only be pivoted back from the upright position after a slight upwards displacement.

Furthermore, the connector 10 comprises a rotational latching device, e.g. in the shape of a hook 15, which is adapted to engage lateral protrusions 3 of the Smith machine in order to lock the connector 10 and barbell 2 assembly at a desired height. The hook 15 is rotationally coupled to the connector 10 and adapted to be rotated about a rotational axis substantially coinciding with the longitudinal axis of the barbell 2 when securely fastened to the connector 10. The rotational coupling or attachment between the connector 10 and the hook 15 may be achieved e.g. by machining a groove following a substantially circular path (shown in phantom in FIGS. 2*a*, 3*a*) in either the connector 10 or the hook 15, and providing a boss adapted to be received in the groove on the other part as known in the art. The boss and groove are shaped such that the connector 10 and hook 15 may be rotated with respect to each other along the path defined by the groove. The length of the groove is adapted such that the hook 15 may only be rotated part of a full revolution, sufficient to engage and disengage the lateral protrusions 3 on the Smith machine.

In addition, the hook 15 comprises a recess 16 adapted to receive the barbell 2, preferably in a form fit connection wherein the shape of the recess 16 corresponds to the shape of the barbell 2. The connection between the hook 15 and the barbell 2 is made to be rotationally rigid. As such, rotation of the barbell 2 is directly transferred to the hook 15 which enables the user to engage and disengage the hook 15 from the protrusions 3 of the Smith machine.

The shape of the recess 16 may be substantially circular and have a design and diameter which substantially matches the shape and cross-sectional diameter of the barbell 2. In order to increase the rigidity of the rotational coupling, the recess 16 and/or the barbell 2 may be covered with a high-friction material such as rubber. Another way of ensuring a rotationally rigid coupling is to provide a magnetic coupling between the hook 15 and the barbell 2 by including magnetic or ferromagnetic materials in the hook 15 and the barbell 2. Since the rotational coupling between the hook 15 and the barbell 2 need not carry the whole weight of the barbell 2, the strength of the rotational coupling only needs to be sufficient to transfer the torque applied to the barbell 2 to the hook 15.

The rotationally rigid coupling between the hook 15 and the barbell 2 may also be achieved by attaching a sleeve 6 on a conventional barbell 2, e.g. an Olympic size barbell, by means of crimping, a fastener such as a screw or any other suitable means. The sleeve 6 may have a regular polygon shape, e.g. quadratic, pentagonal, hexagonal, heptagonal, octagonal etc. In this case, the recess 16 of the hook 15 may be formed with a corresponding regular polygon shape to receive the sleeve 6 therein. Hence, rotation of the barbell 2 and the sleeve 6 attached thereto is directly transferred to the hook 15 as described above.

In some embodiments, the support arm 11 may further comprise an elongated element (not shown), such as a rod or a bar, pivotally connected at one end to the free end of the support arm 11. In a first, non-engaged position, the elongated element is vertically suspended from the support arm 11. The vertical element may act as a locking mechanism for the barbell, when the barbell is received in the recess 16, such that the vertical element is pivoted around the free end of the support arm 11 into a second, engaged position, wherein the element abuts against and engages with the barbell, or the sleeve attached to the barbell, received in the recess, in order to lock the barbell in place. Preferably, the bottom side of the vertical element is flat for abutting against and engaging with a flat part of the sleeve, when locking the barbell in place. The length of the elongated element is preferably approximately the same as, or slightly greater than, the distance between the end of the support arm and the barbell, when it is received in the recess, such that the elongated element is at a slight angle relative to a horizontal plane in the second position.

Figure 3A:
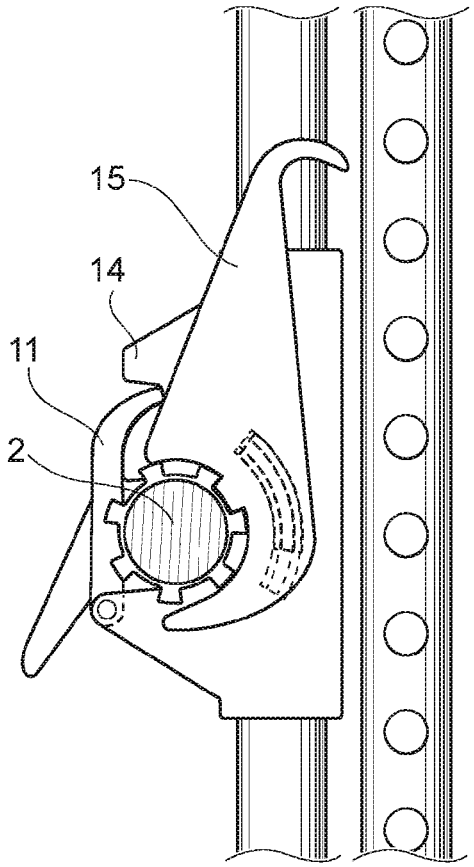
FIGS. 3*a* and 3*b* show side and frontal views of the connector in FIG. 1 in a second position.
Figure 3B:
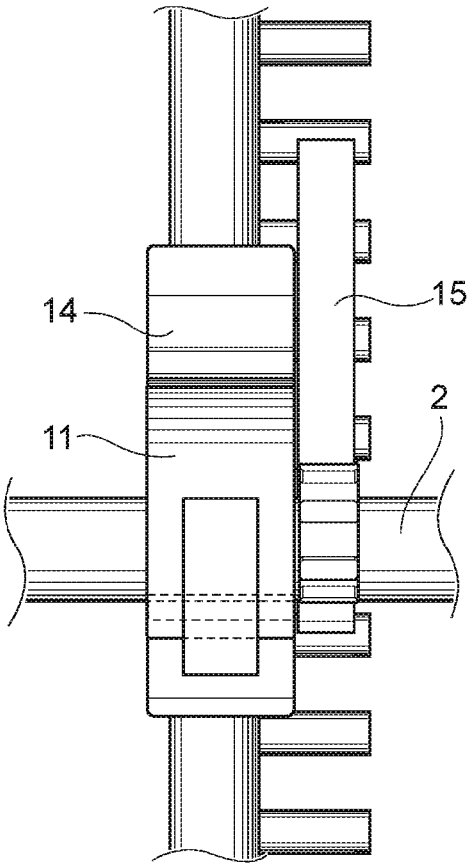

Yet another solution is to provide the sleeve 6 with an external gear 7, and at least part of the surface of the recess 16 may be formed with the shape of a corresponding internal gear 17. As shown in FIGS. 2*a*, 3*a*, the internal gear 17 comprises one cog, but may of course have a plurality of cogs evenly distributed along the surface of the recess 16. When inserted into the recess 16, the external gear 7 of the sleeve 6 meshes with the internal gear 17 of the recess 16 to provide a rotationally rigid coupling. In order to enable easy insertion of the barbell 2 into the recess 16, the internal gear 17 is formed only on a part of the surface of the recess 16, such as e.g. one third or one quarter of a circle.

In use, the user pushes the barbell 2 towards the connector 10 to insert the barbell 2, with or without the sleeve 6, into the corresponding recess 16 of the hook 15 on either side of the Smith machine and subsequently pivots the support arm 11 to the second position shown in FIG. 3*a* to lock the barbell 2 in place. Next, the user rotates the barbell 2 to disengage the hook 15 from the protrusions 3 on the posterior rack or frame of the Smith machine and begins to lift. When the desired number of repetitions have been completed, the user rotates the barbell 2 in the opposite direction to re-engage the hook 15 with the protrusions 3 and the barbell 2 remains fixed at the selected height.

When the user wishes to change from fixed controlled movement in the Smith machine to free weight exercise, he or she releases the support arm 11 and pivots it back towards the first position, and then pulls the barbell 2 out from the recess 16 such that the barbell 2 rests on the support arm 11 in the first position.

Figure 4:
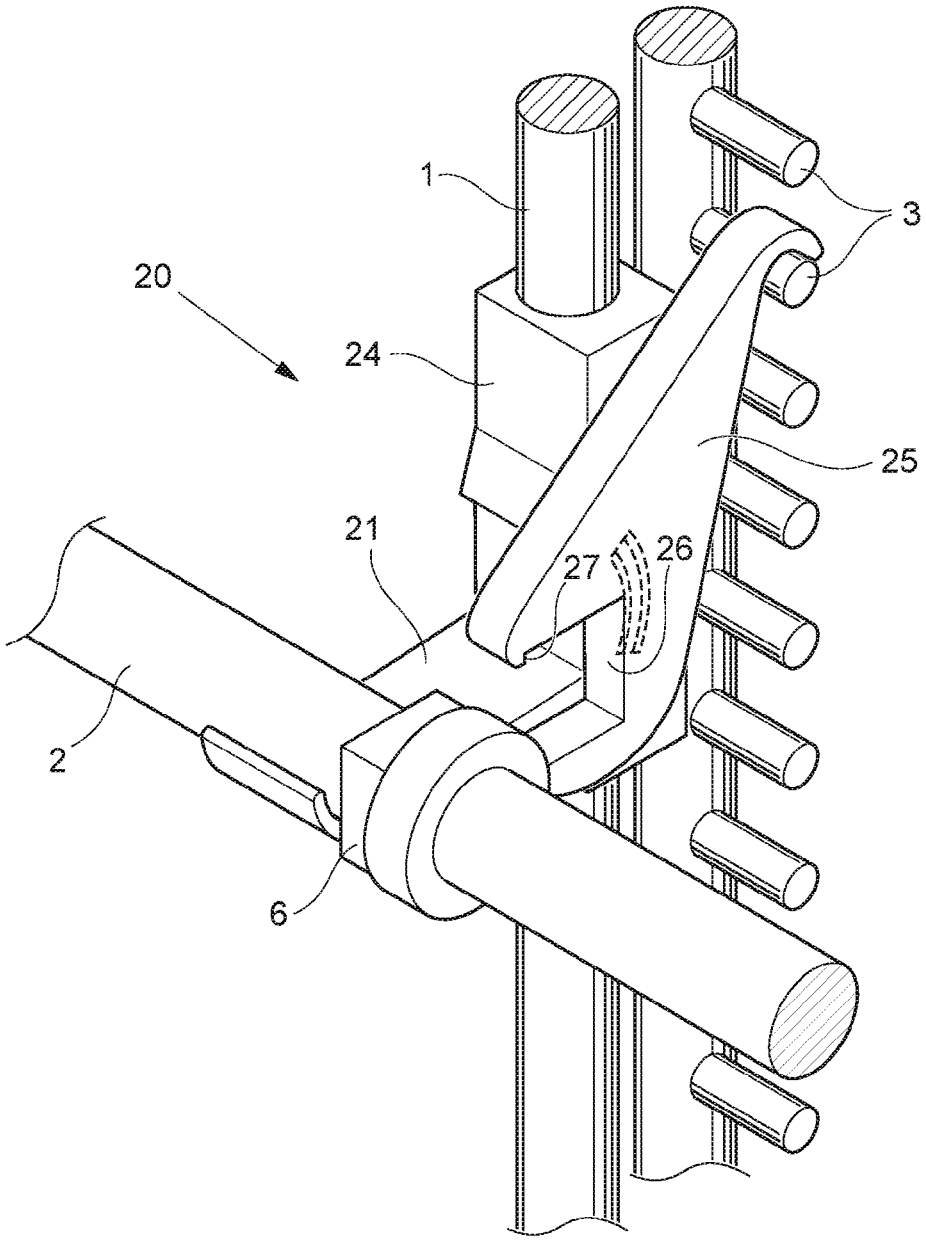
FIG. 4 shows a perspective view of a connector according to a second embodiment.

In a second embodiment of securing means, as shown in FIG. 4, the hook 25 itself constitutes the securing means for the barbell 2. The support arm 21 is then integrally formed with or rigidly attached to the main body 24 of the connector 20 in order to remain in a fixed, outwardly extending position for supporting the barbell 2 during free weight exercise. As described above, the hook 25 is rotationally attached to the connector 20 in order to be rotated about a substantially horizontal axis coinciding with the axis of the barbell 2.

The rotationally rigid coupling between the hook 25 and the barbell 2 may be achieved by attaching a sleeve 6, on a conventional barbell 2, e.g. an Olympic size barbell, as explained in connection with the embodiment above, by means of crimping, a fastener such as a screw or any other suitable means. The sleeve 6 may have a regular polygon shape, e.g. quadratic, pentagonal, hexagonal, heptagonal, octagonal etc. In this case, the recess 26 of the hook 25 may be formed with a corresponding regular polygon shape to receive the sleeve 6 therein. Hence, rotation of the barbell 2 and the sleeve 6 attached thereto is directly transferred to the hook 25 as described above.

Figure 5A:
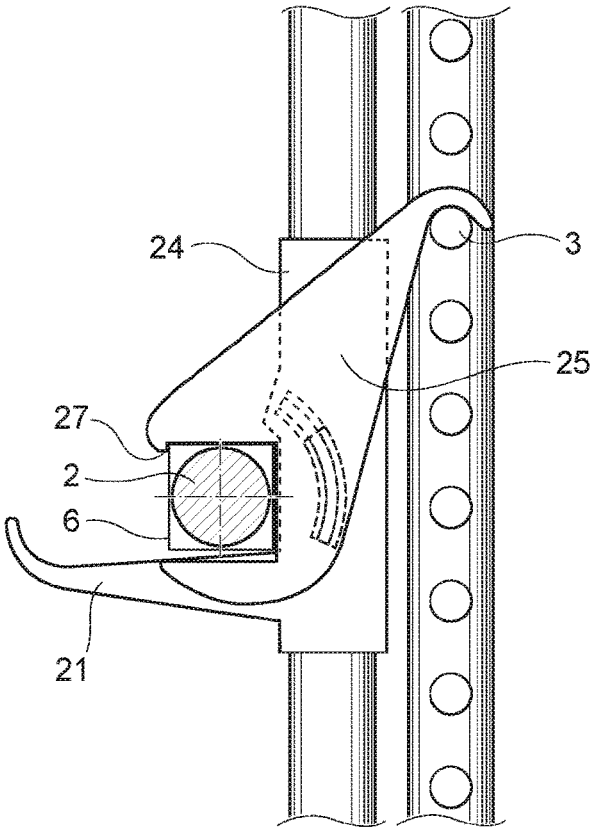
FIGS. 5*a* and 5*b* show side and frontal views of the connector in FIG. 4.
Figure 5B:
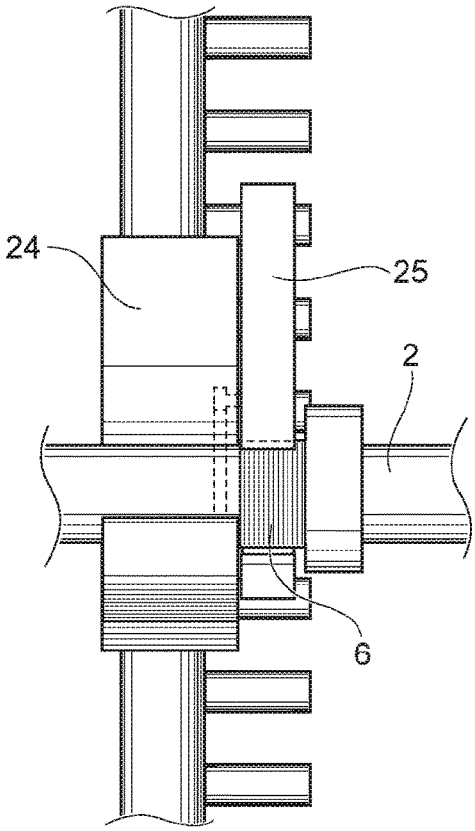
Figure 6:
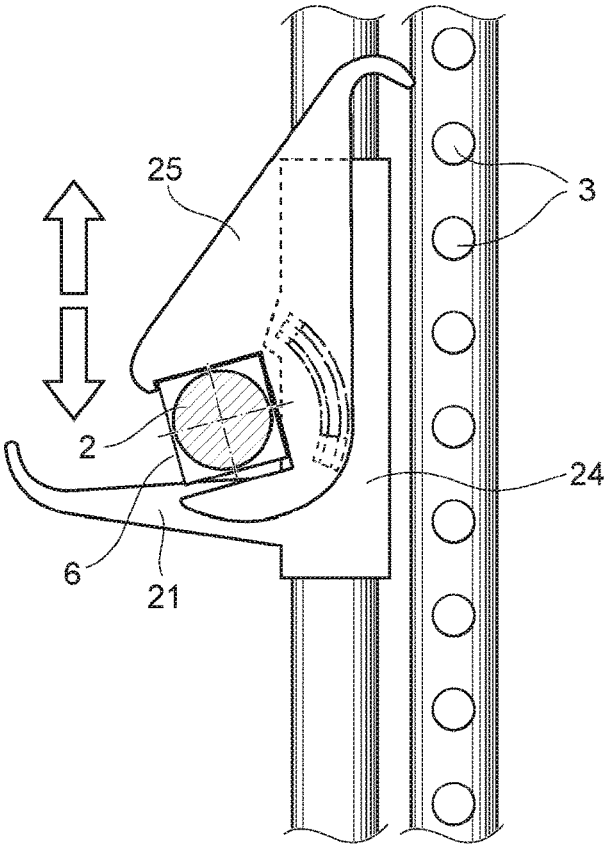
FIG. 6 shows a side view of the connector in FIG. 4 with a barbell received therein in a fixed movement state.
Figure 7:
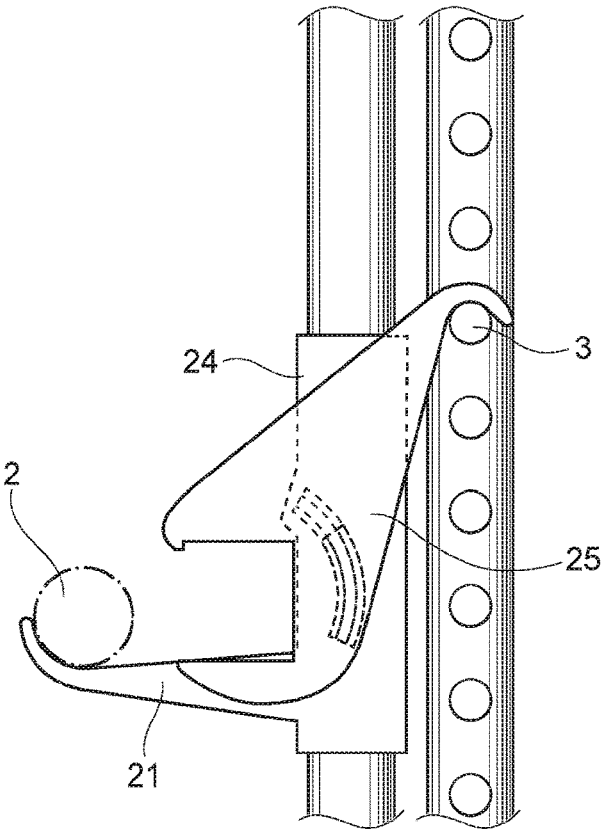
FIG. 7 shows a side view of the connector in FIG. 4 with a barbell supported thereon in a free weight exercise state.

In the embodiment shown in FIG. 4, the recess 26 and the sleeve 6 attached to the barbell 2 are formed to create a releasable form-fit connection when the barbell 2 is inserted into the connector 20. The form-fit connection can be achieved e.g. by providing the sleeve 6 (male part) and the recess 26 (female part) with corresponding quadratic shapes, as shown in FIGS. 5*a* and 5*b*. Furthermore, the upper part of the recess 26 comprises a shoulder 27 extending towards the lower part of the recess 26 across the opening. The shoulder 27 functions as a retaining member adapted to retain the sleeve 6 within the recess 26 when the barbell 2 is rotated. This rotational movement is transferred to the hook 25 to disengage it from the protrusions 3 on the Smith machine. In this position, the connector 20 and hook 25 are held by the barbell 2 due to the form-fit connection between the recess 26 and the sleeve 6, aided by the retaining shoulder 27.

Of course, the shape of the recess 26 may also be substantially circular and have a design and diameter which substantially matches the shape and cross-sectional diameter of the barbell 2 without the sleeve 6. In order to increase the rigidity of the rotational coupling and ensure that the barbell 2 remains secured by the hook 25, the recess 26 and/or the barbell 2 may be covered with a high-friction material such as rubber. Another way of ensuring a rotationally rigid coupling is to provide a magnetic coupling between the hook 25 and the barbell 2 by including magnetic or ferromagnetic materials in the hook 25 and the barbell 2. Since the rotational coupling between the hook 25 and the barbell 2 need not carry the whole weight of the barbell 2, the strength of the rotational coupling only needs to be sufficient to transfer the torque applied to the barbell 2 to the hook 25.

In use, the user pushes the barbell 2 towards the connector 20 to insert the sleeve 6 into the corresponding recess 26 of the hook 25 on either side and subsequently lifts the barbell 2 slightly to engage the sleeve 6 in the recess 26 behind the retaining shoulder 27. The size of the opening of the recess 26, including the shoulder 27, is adapted to the size of the sleeve 6 to allow insertion of the latter. Next, the user rotates the barbell 2 to disengage the hook 25 from the protrusions 3 on the posterior rack or frame of the Smith machine and begins to lift. When the desired number of repetitions have been completed, the user rotates the barbell 2 in the opposite direction to re-engage the hook 25 with the protrusions 3 and the barbell 2 remains fixed at the selected height.

When the user wishes to change from fixed controlled movement in the Smith machine to free weight exercise, he or she pushes the barbell 2 slightly downwards to release the sleeve 6 from the shoulder 27 and then pulls the barbell 2 out from the recess 26 such that the barbell 2 rests on the support arm 21.

In order to prevent rotation of the connector about the rail of the Smith machine, the internal bore of the connector, in which the rail is received, may be provided with a longitudinal boss or groove adapted to engage with a corresponding groove or boss arranged on the rail of the Smith machine.

As mentioned above, the connector according to the present invention may be retrofitted to an existing Smith machine or similar weight lifting apparatus to provide the dual function of controlled movement in a fixed path with free weight exercise in a single piece of exercise equipment. This can save considerable costs in that existing equipment need not be fully replaced. Of course, the connector may also mounted on a weight lifting apparatus already upon manufacture, which is also envisaged by the present invention.

Preferred embodiments of a connector for a weight lifting apparatus according to the invention have been described. However, the person skilled in the art realises that this can be varied within the scope of the appended claims without departing from the inventive idea.

All the described alternative embodiments above or parts of an embodiment can be freely combined without departing from the inventive idea as long as the combination is not contradictory.

The invention claimed is:

1. A connector for a weightlifting apparatus, the connector comprising:

a main body adapted to be slidably attached to a sliding rail of the weightlifting apparatus;

a support arm having a support surface and extending outwardly from the main body;

a rotational latching device having first and second opposing ends, the first opposing end adapted to engage slots or lateral protrusions of the weightlifting apparatus, and the second opposing end comprising a recess adapted to receive a barbell in a form-fit connection to achieve a rotationally rigid coupling such that rotation of the barbell is transferred to the rotational latching device; and a barbell securing means connected to the second opposing end and adapted to releasably lock the barbell in the recess;

wherein the support surface is adapted to support the barbell during free weight exercise when the barbell is not locked by the barbell securing means, and when the first opposing end is engaged with the slots or lateral protrusions of the weightlifting apparatus.

2. The connector according to claim 1, wherein the first opposing end of the rotational latching device is shaped like a hook.

3. The connector according to claim 1, further comprising a sleeve adapted to be fastened on the barbell and having a shape corresponding to a shape of the recess.

4. The connector according to claim 3, wherein the recess and the sleeve both have corresponding regular polygon shapes, preferably a quadratic or hexagonal shape.

5. The connector according to claim 1, wherein the main body comprises an internal bore with a longitudinal boss or groove adapted to engage with a corresponding groove or boss arranged on the sliding rail, and wherein the sliding rail is adapted to be received in the internal bore.

6. A weightlifting apparatus comprising at least one sliding rail, at least one set of slots or lateral protrusions respectively corresponding to each sliding rail, and at least one connector, each connector comprising:

a main body adapted to be slidably attached to a respective one sliding rail of the weightlifting apparatus;

a support arm having a support surface and extending outwardly away from the main body;

a rotational latching device having first and second opposing ends, the first opposing end adapted to engage one set of the slots or lateral protrusions of the weightlifting apparatus, and the second opposing end comprising a recess adapted to receive a barbell in a form-fit connection to achieve a rotationally rigid coupling such that rotation of the barbell is transferred to the rotational latching device; and a barbell securing means connected to the second opposing end and adapted to releasably lock the barbell in the recess;

wherein the support surface is adapted to support the barbell during free weight exercise when the barbell is not locked by the barbell securing means, and when the first opposing end is engaged with the one set of the slots or lateral protrusions of the weightlifting apparatus.

* * * * *